US008561624B2

(12) United States Patent
Oblinger et al.

(10) Patent No.: US 8,561,624 B2
(45) Date of Patent: Oct. 22, 2013

(54) HYDRAULIC COUPLING OF A VERTICALLY ADJUSTABLE DISH BASKET OF A DISHWASHER

(75) Inventors: Anton Oblinger, Wertingen (DE); Karlheinz Rehm, Dischingen Ortst. Trugenhofen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 566 days.

(21) Appl. No.: 12/674,720

(22) PCT Filed: Aug. 25, 2008

(86) PCT No.: PCT/EP2008/061083

§ 371 (c)(1), (2), (4) Date: Feb. 23, 2010

(87) PCT Pub. No.: WO2009/027370

PCT Pub. Date: Mar. 5, 2009

(65) Prior Publication Data

US 2011/0155190 A1 Jun. 30, 2011

(30) Foreign Application Priority Data

Aug. 31, 2007 (DE) ..... 10 2007 041 307

(51) Int. Cl.

| | |
|---|---|
| ***B08B 3/00*** | (2006.01) |
| ***B08B 3/12*** | (2006.01) |
| ***B08B 6/00*** | (2006.01) |

(52) U.S. Cl.

USPC ..... 134/172; 134/135; 134/180

(58) Field of Classification Search

USPC ..... 134/135, 172, 180

See application file for complete search history.

(56) References Cited

U.S. PATENT DOCUMENTS

| | | | | |
|---|---|---|---|---|
| 5,823,211 | A | 10/1998 | Wilhelmstaetter et al. | |
| 6,033,142 | A | 3/2000 | Gueret | |
| 6,431,188 | B1 * | 8/2002 | Laszczewski et al. | 134/56 D |
| 2006/0185700 | A1 * | 8/2006 | Lee | 134/198 |

FOREIGN PATENT DOCUMENTS

| | | | |
|---|---|---|---|
| DE | 2355271 | A1 | 5/1975 |
| DE | 3125853 | A1 | 4/1983 |
| DE | 69800150 | T2 | 3/2001 |
| EP | 0 786 231 | * | 1/1997 |
| EP | 0 829 221 | * | 9/1997 |
| EP | 0 864 291 | * | 9/1998 |
| EP | 1935322 | A2 | 6/2008 |

(Continued)

*Primary Examiner* — Joseph L Perrin
*Assistant Examiner* — Charles W Kling
(74) *Attorney, Agent, or Firm* — James E. Howard; Andre Pallapies

(57) ABSTRACT

A dishwasher having a washing compartment with a sidewall; a height-adjustable basket that can be at least partially withdrawn from the washing compartment; a spray arm; a feed pipe, disposed on the basket, for the spray arm; and a coupling device. The coupling device has a first part-coupling that is disposed on the sidewall and that has first openings arranged vertically one above another. The coupling device also has a second part-coupling that is connected to the feed pipe and that has a second opening which, depending on a height adjustment of the basket, cooperates with one of the first openings such that washing liquor passes through that opening and the second opening and flows via the feed pipe to the spray arm. The washing liquor is discharged under pressure from the first openings. The second part-coupling closes the remaining first openings.

14 Claims, 7 Drawing Sheets

(56) References Cited

FOREIGN PATENT DOCUMENTS

| | | | |
|---|---|---|---|
| WO | WO 83/01892 | * | 6/1983 |
| WO | WO 98/02082 | * | 1/1998 |
| WO | WO 2009/008827 | * | 1/2009 |
| WO | WO 2009/083382 | * | 7/2009 |

* cited by examiner

HYDRAULIC COUPLING OF A VERTICALLY ADJUSTABLE DISH BASKET OF A DISHWASHER

BACKGROUND OF THE INVENTION

The invention relates to a dishwasher having a height-adjustable basket on which a feed pipe for a spray arm is disposed.

A dishwasher of said type is disclosed e.g. in EP 0 796 587 A2. Fixed to the rear wall of the washing compartment (tub) of said dishwasher is a supply line by means of which the feed pipe for a spray arm, which feed pipe is secured horizontally to a height-adjustable basket of the dishwasher, can be connected by means of a coupling. In the direction toward the feed pipe the supply line has an open connection fitting protruding in the direction of the feed pipe and two closed blind fittings protruding in the direction of the feed pipe. One of the closed blind fittings is arranged above and the other blind fitting is arranged below the connection fitting. The coupling comprises two openings arranged one above the other, into which openings the connection fitting and one of the blind fittings projects in each case. Depending on the height adjustment of the dishwasher basket, the connection fitting projects into one or other of the coupling openings. Depending on which opening is used, a washing liquor that is under pressure can either flow from the supply line directly into the feed pipe or is routed into the feed pipe via the housing of the coupling. Redirecting the washing liquor via the housing of the coupling is hydraulically unfavorable, however.

BRIEF SUMMARY OF THE INVENTION

The object of the present invention is therefore to provide a dishwasher having a height-adjustable basket on which a feed pipe for a spray arm is disposed, said dishwasher affording a precondition for an improved hydraulic guidance of the washing liquor coming from the supply line into the feed pipe.

The object of the invention is achieved by means of a dishwasher comprising a washing compartment having at least one sidewall, a height-adjustable basket which can be at least partially withdrawn from the washing compartment, a spray arm, a feed pipe, disposed on the basket, for the spray arm, and a coupling device comprising a first part-coupling and a second part-coupling, wherein the first part-coupling is disposed on the sidewall and a number N of first openings arranged vertically one above the other from which a washing liquor under pressure can be discharged during operation of the dishwasher, the second part-coupling is connected to the feed pipe and has a second opening which, depending on the height adjustment of the dishwasher basket, cooperates with one of the first openings of the first part-coupling, such that during operation of the dishwasher the washing liquor passes through the first opening cooperating with the second opening and through the second opening and flows via the feed pipe to the spray arm, and the second part-coupling is embodied in such a way that it closes the remaining first openings that are not cooperating with the second opening.

The dishwasher according to the invention has the coupling device via which the feed pipe for the spray arm, which feed pipe is disposed in particular horizontally on the height-adjustable basket, is supplied with the washing liquor during operation of the dishwasher. The coupling device has the first part-coupling which is disposed on the sidewall of the washing compartment and which in turn is provided with the first openings. The washing liquor under pressure can potentially flow out through the first openings. The sidewall can be in particular the rear wall of the washing compartment.

The second part-coupling of the coupling device is connected to the feed pipe and has the second opening. Depending on the height adjustment of the dishwasher basket, the second opening cooperates with one of the first openings such that the washing liquor is able to pass through said first opening and through the second opening into the feed pipe. Accordingly, the washing liquor always flows into the feed pipe through the second opening of the second part-coupling. If, for example, the dishwasher according to the invention is embodied in such a way that the second part-coupling is connected to the feed pipe such that the washing liquor can flow directly into the feed pipe via the second opening, without, for example, being diverted by a wall of the second part-coupling, preconditions are established whereby during operation of the dishwasher according to the invention the washing liquor will always flow via the coupling device directly into the feed pipe, irrespective of the height adjustment of the dishwasher basket, thereby enabling a relatively favorable hydraulic guidance of the washing liquor.

Furthermore, the second part-coupling is embodied in such a way that during operation of the dishwasher it closes the remaining first openings that are not cooperating with the second opening such that the washing liquor flows only through the first opening that is cooperating with the second opening.

According to a variant of the inventive dishwasher the first part-coupling has substantially uniform first connection pieces, each of which encompasses one of the first openings, and the second opening of the second part-coupling is embodied in such a way that the first connection pieces can be inserted into the second opening. This embodiment variant allows, for example, the desired first opening to cooperate reliably with the second opening. In this way it can, for example, be avoided that the relevant first opening and the second opening will partially overlap, thereby reducing the size of the cross-section for supplying the washing liquor to the feed pipe, which under certain conditions could result in a deterioration in the quality of the washing operation.

What is understood by a connection piece is in particular a relatively short connecting pipe, wherein in this context the cross-section of the connection pieces does not necessarily have to be embodied as circular.

Above and below the second opening the second part-coupling can have at least (N−1) recesses into which the remaining first connection pieces that are not cooperating with the second opening can be inserted in order to close their first openings. This enables the remaining first openings through which no washing liquor is to flow during the operation of the dishwasher according to the invention to be closed more effectively. The recesses can be provided in particular with seals.

The second opening can have a conical shape narrowing toward the interior of the second part-coupling and/or the first connection pieces can have a conical shape narrowing toward the exterior of the first part-coupling. This can assist a reliable introduction of the relevant first connection piece into the second opening and where applicable an introduction of the remaining first connection pieces into the recesses of the second part-coupling.

The first connection pieces can have seals which at least partially surround the exterior of the first connection pieces. The seals can assist reliable closing of the remaining first openings, in particular in combination with the recesses of the second part-coupling.

According to a variant of the inventive dishwasher its second part-coupling has a second connection piece which encompasses the second opening, and its first openings of the first coupling are embodied in such a way that the second connection piece can be inserted into the first openings. This embodiment variant enables, for example, the desired first opening to cooperate reliably with the second opening. This embodiment variant allows, for example, the desired first opening to cooperate reliably with the second opening. In this way it can, for example, be avoided that the relevant first opening and the second opening will partially overlap, thereby reducing the size of the cross-section for supplying the washing liquor to the feed pipe, which under certain conditions could result in a deterioration in the quality of the washing operation.

The first openings can have a conical shape narrowing toward the interior of the first part-coupling and/or the second connection piece can have a conical shape narrowing toward the exterior of the second part-coupling. This can assist a reliable introduction of the second connection piece into the relevant first opening.

The second connection piece can have a seal which at least partially surrounds the exterior of the second connection piece.

According to a further embodiment variant of the inventive dishwasher its second part-coupling has, above and below the second connection piece, (N−1) plugs which can be inserted into the remaining first openings that are not cooperating with the second opening of the second connection piece in order to close said openings. The plugs can assist a reliable closing of the remaining first openings.

The plugs can have a conical shape narrowing toward the exterior of the second part-coupling, as a result of which a reliable introduction of the plugs into the remaining first openings can be assisted.

In order where necessary to assist reliable closing of the remaining first openings, the plugs can have seals which at least partially surround the exterior of the plugs.

According to a further variant of the inventive dishwasher the second part-coupling has, above and below the second connection piece, (N−1) third connection pieces which substantially correspond to the second connection piece and third openings corresponding to the second opening, which third openings are in each case closed by means of a removable or non-removable closing device, wherein the third connection pieces can be inserted into the remaining first openings that are not cooperating with the second opening of the second connection piece in order to close said openings. The third connection pieces closed by means of the closing devices act similarly to the plugs of the aforementioned variant of the dishwasher according to the invention. Since the third connection pieces substantially correspond to the second connection piece, it can be possible to manufacture the second part-coupling more cheaply. The closing devices can be, for example, in particular conically shaped covers which can be e.g. removably snapped in place, clamped or screwed onto the third openings of the third connection pieces. The third openings can also be non-removably connected to the third connection pieces in order to close the third openings.

The third connection pieces and/or the closing devices of the third connection pieces can have a conical shape narrowing toward the exterior of the second part-coupling in order e.g. to assist a reliable introduction of the third connection pieces into the remaining first openings.

In order to reliably close the remaining first openings, the third connection pieces can have, for example, seals which at least partially surround the exterior of the third connection pieces.

According to an embodiment variant of the inventive dishwasher the first part-coupling has substantially uniform first connection pieces, each of which encompasses one of the first openings, and the second part-coupling has the second connection piece and where applicable the plugs or, as the case may be, the third connection pieces closed by means of the closing devices, wherein the second connection piece is inserted into the relevant first connection piece during operation of the dishwasher and where applicable the plugs or, as the case may be, the third connection pieces are inserted in the remaining first connection pieces. This embodiment variant can have the following advantages:

Hydraulically favorable, since the cross-sections of the first opening can be embodied to be substantially identical;

relatively small space requirement for the dishwasher basket, which is in particular an upper basket, since the coupling device can be embodied to be relatively small;

weight compensation of the dishwasher basket can be provided;

reliable closing of the remaining first openings can be achieved by means of the plugs or, as the case may be, connection pieces;

the coupling device can be embodied in such a way that it has no moving seals, and all the necessary seals can be disposed on the second part-coupling.

To provide a relatively low-cost embodiment, the second part-coupling and the feed pipe can be embodied as a single piece. If the dishwasher according to the invention has a supply pipe for the washing liquor disposed on the sidewall, the supply pipe can be connected to the first part-coupling and in particular be embodied as a single piece with the first part-coupling.

BRIEF DESCRIPTION OF THE DRAWINGS

An exemplary embodiment of the invention is illustrated by way of example in the attached schematic drawings, in which.

DETAILED DESCRIPTION OF EXEMPLARY EMBODIMENTS OF THE PRESENT INVENTION

Figure 1:
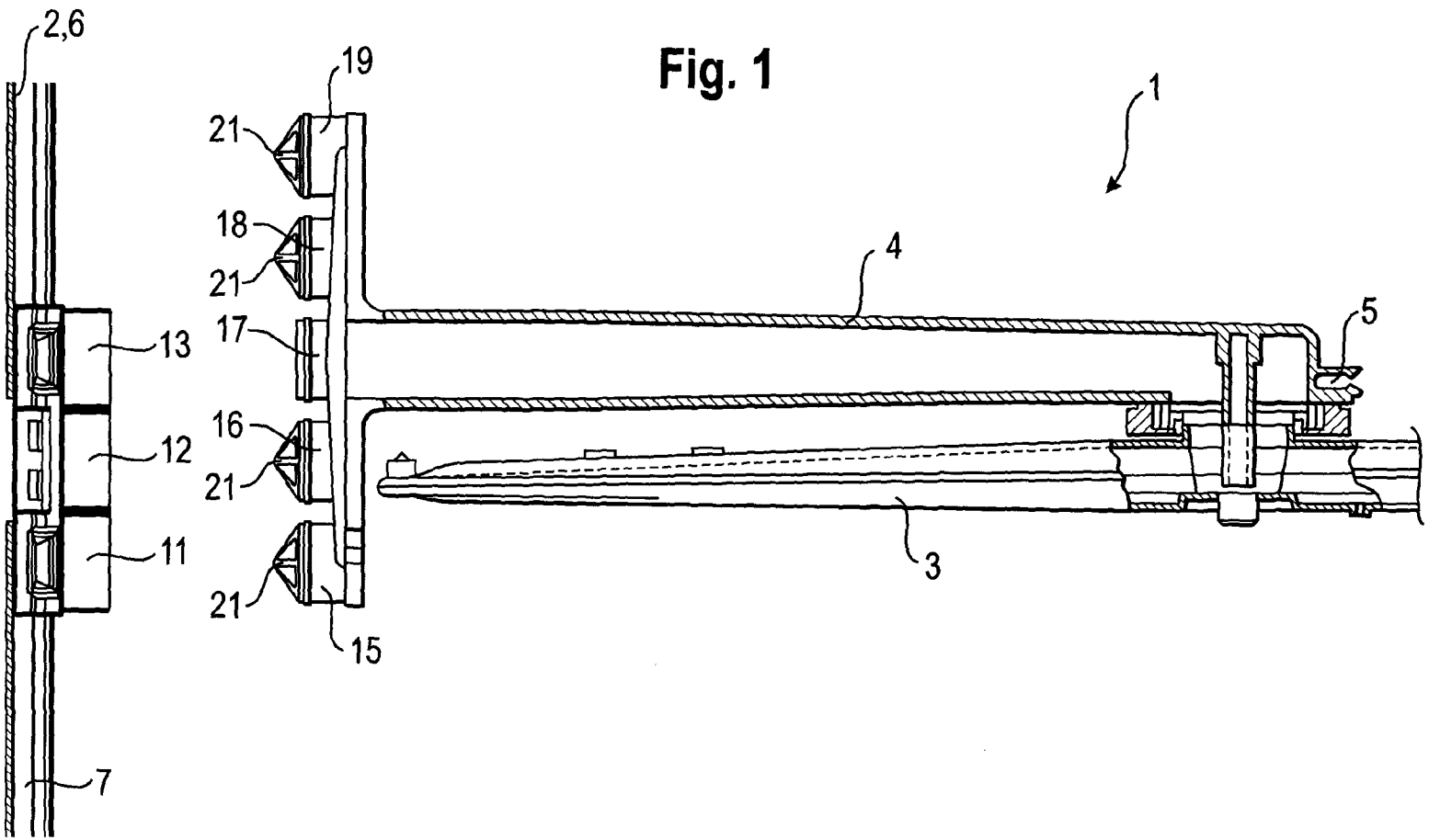
FIG. 1 shows a section through a part of a dishwasher having a coupling for connecting a feed pipe of a spray arm.

FIG. 1 shows a section of a part of a dishwasher 1 having a washing compartment 2 (only part of which is shown) from which a height-adjustable basket (which is not shown in further detail but is generally known) can be at least partially withdrawn. A spray arm 3 and its feed pipe 4 are fixed to the dishwasher basket. The spray arm 3 is supported on the—in the case of the present exemplary embodiment—horizontally running feed pipe 4 by means of a mount which is not explained in further detail and the feed pipe 4 is secured to the dishwasher basket by means of a retainer 5 which, in the case of the present exemplary embodiment, is integrally molded on the feed pipe 4 as a single piece via longitudinal wires (not shown) of the dishwasher basket.

Figure 2:
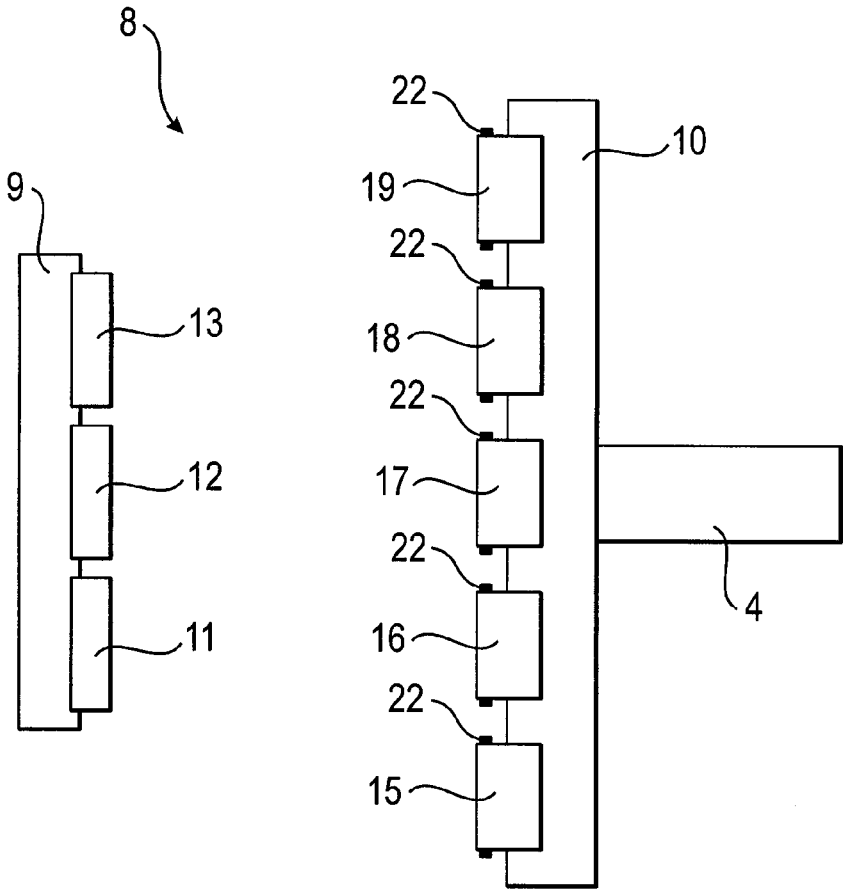
FIGS. 2-7 show different views of the coupling for connecting the feed pipe.
Figure 3:
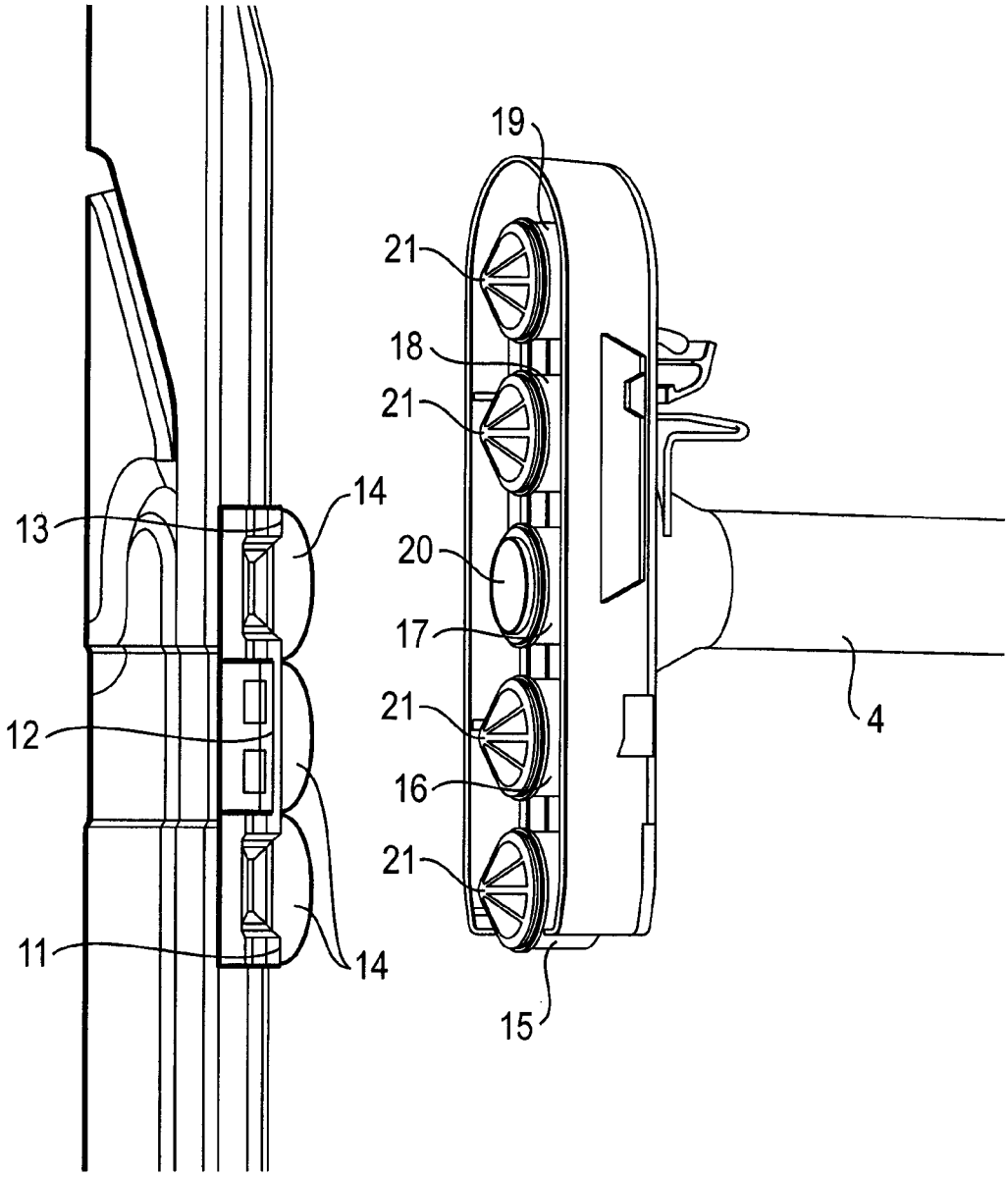
Figure 4:
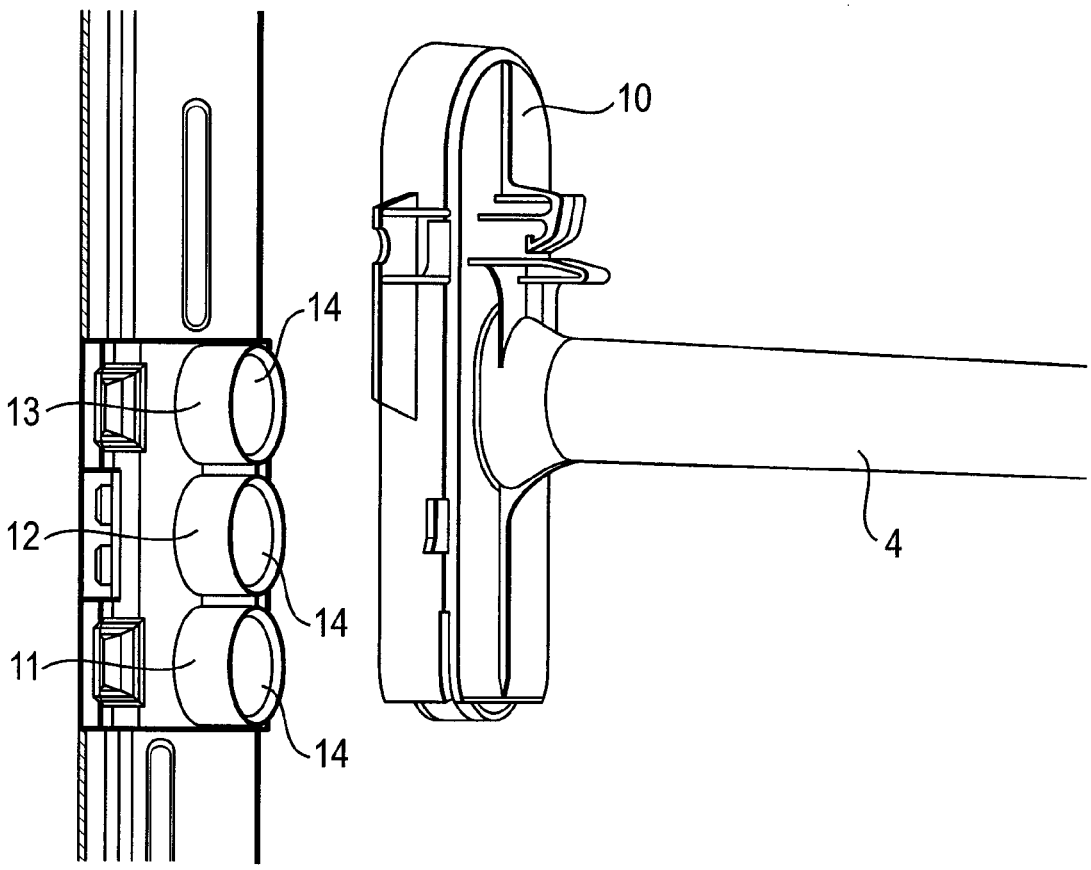

Fixed to a sidewall of the washing compartment 2, to the rear wall 6 of the washing compartment 2 in the case of the present exemplary embodiment, is a supply pipe 7 through which a washing liquor under pressure can be guided via the feed pipe 4 to the spray arm 3 during operation of the dishwasher 1. In order to couple the feed pipe 4 to the supply pipe 7, the dishwasher 1 comprises, in the case of the present exemplary embodiment, a coupling 8 (shown in more detail in FIG. 2) comprising a first part-coupling 9 and a second part-coupling 10. Further views of the coupling 8 are shown in FIGS. 3-7.

In the case of the present exemplary embodiment the first part-coupling 9 is connected to the supply pipe 7 or, as the case may be, is embodied with the latter as a single piece and has three open and substantially identically embodied cylindrical connection pieces 11-13 which are arranged vertically one above the other and can have a conical shape narrowing toward the interior of the first part-coupling 9. The connection pieces 11-13 each have an opening 14 through which washing liquor under pressure that is channeled to the first part-coupling 9 by means of the supply pipe 7 during operation of the dishwasher 1 can be discharged. Furthermore, the connection pieces 11, 13 arranged above and below the middle connection piece 12 are each disposed at an equal distance from the middle connection piece 12.

In the case of the present exemplary embodiment the second part-coupling 10 comprises five substantially identically embodied cylindrical connection pieces 15-19 which are arranged one above the other and each have an opening 20. The connection pieces 15-19 can have a conical shape narrowing toward the exterior of the second part-coupling 10 and the distances between each pair of adjacent connection pieces 15-19 are substantially identical. Furthermore, the outer diameters of the individual connection pieces 15-19 of the second part-coupling 10 are embodied in such a way that said connection pieces can be inserted into the openings 14 of the connection pieces 11-13 of the first part-coupling 9. In addition the connection pieces 15, 16, 18, 19 arranged above and below the middle connection piece 17 of the second part-coupling 10 are each provided with a cover 21 which closes the openings 20 of each of said connection pieces 15, 16, 18, 19. The covers 21 can be removably or non-removably connected to the connection pieces 15, 16, 18, 19 and have a conical shape.

The two part-couplings 9, 10 are provided for the purpose of being inserted one into the other during the operation of the dishwasher 1. Depending on the height adjustment of the dishwasher basket, when the basket is introduced into the washing compartment 2, the middle connection piece 17 of the second part-coupling 10 is inserted into the opening 14 of one of the three connection pieces 11-13 of the first part-coupling 9.

Figure 5:
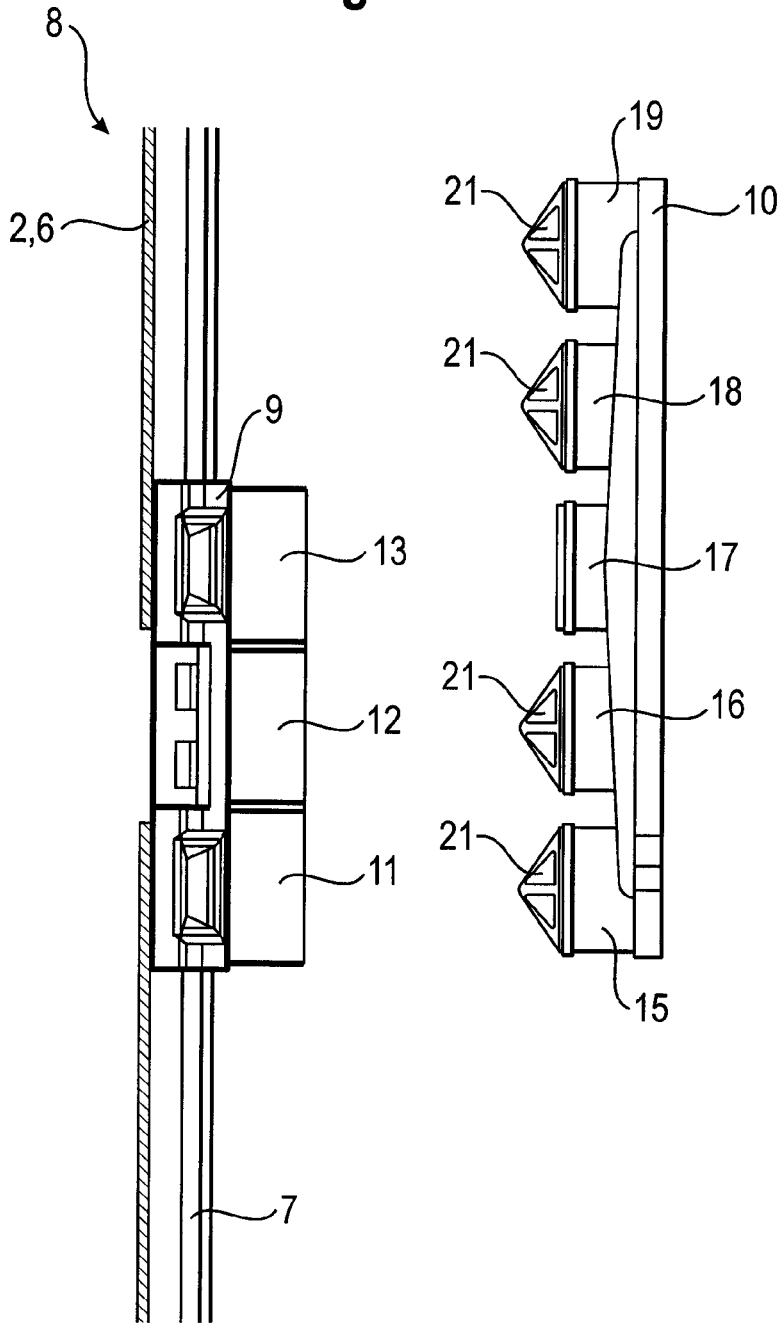

FIG. 5 illustrates a scenario in which the dishwasher basket is situated in an upper position and accordingly, when the basket is introduced into the washing compartment 2, the middle connection piece 17 of the second part-coupling 10 is guided into the opening 14 of the upper connection piece 13. The two other connection pieces 11, 12 of the first part-coupling 9 are disposed at a distance from one another and the remaining connection pieces 15, 16, 18, 19 of the second part-coupling 10 that are closed by means of the covers 21 are disposed at a distance from one another in such a way that the lower connection pieces 15, 16 closed by means of covers 21 are pushed into the openings 14 of the connection pieces 11, 12 and in the process close the openings 14 of the connection pieces 11, 12.

Figure 6:
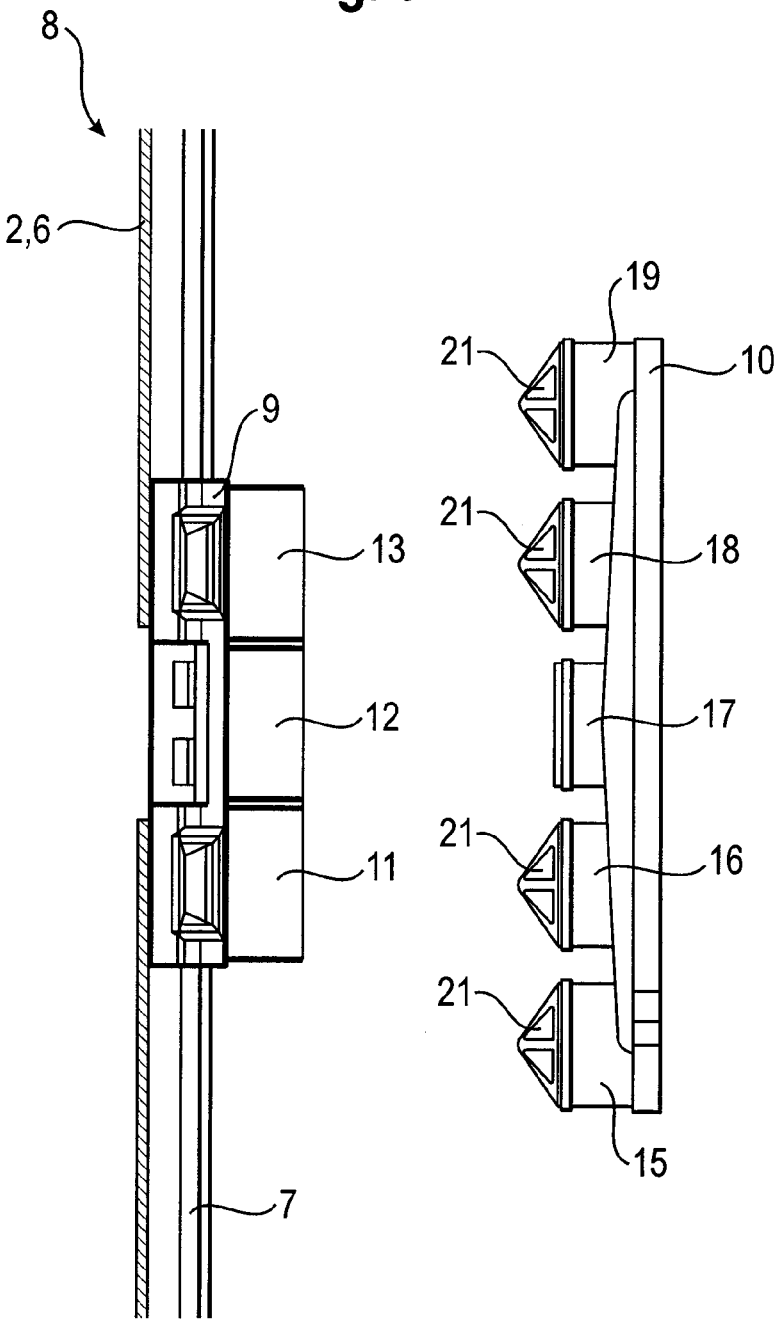

FIG. 6 illustrates a scenario in which the dishwasher basket is situated in a middle position and accordingly, when the basket is introduced into the washing compartment 2, the middle connection piece 17 of the second part-coupling 10 is guided into the opening 14 of the middle connection piece 12. The connection piece 16, which is closed by means of the cover 21 and is situated directly below the middle and unclosed connection piece 17 of the second part-coupling 10, is pushed into the lower connection piece 11 of the first part-coupling 9 in order to close the opening 14 of said connection piece 11. The connection piece 18, which is closed by means of the cover 21 and is situated directly above the middle and unclosed connection piece 17 of the second part-coupling 10, is pushed into the upper connection piece 13 of the first part-coupling 9 in order to close the opening 14 of said connection piece 13.

Figure 7:
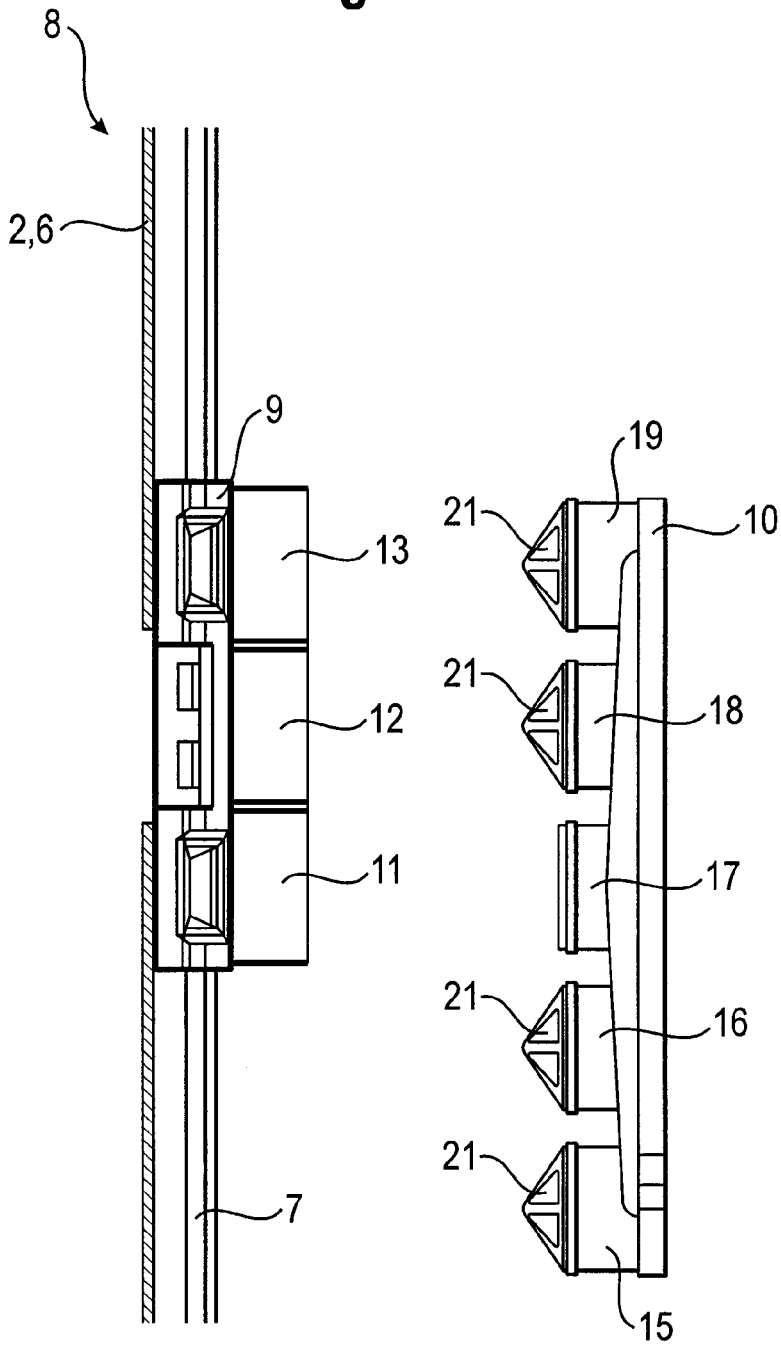

FIG. 7 illustrates a scenario in which the dishwasher basket is situated in a lower position and accordingly, when the basket is introduced into the washing compartment 2, the middle and unclosed connection piece 17 of the second part-coupling 10 is guided into the opening 14 of the lower connection piece 11. The two closed connection pieces 18, 19 arranged above the middle and unclosed connection piece 17 are pushed into the two remaining connection pieces 12, 13 of the first part-coupling 9 in order to close the connection pieces 12, 13.

In the case of the present exemplary embodiment the second part-coupling 10 and the feed pipe 4 are furthermore embodied as a single piece in such a way that the middle connection piece 17 of the second part-coupling 10 constitutes a part of the feed pipe 4. Thus, the washing liquor under pressure passes via the opening 14 of the connection piece 11, 12, 13 of the first part-coupling 9, in which connection piece the unclosed connection piece 17 of the second part-coupling 10 is inserted, and flows directly into the feed pipe 4, without being rerouted via a wall of the second part-coupling 10.

In the case of the present exemplary embodiment the connection pieces 15-19 of the second part-coupling 10 are provided with seals 22.

During the operation of the dishwasher 1 the washing liquor to be sprayed by the spray arm 3 is delivered by a circulating pump (not shown) via the supply pipe 7 and via the feed pipe 4 into the supply pipe 7.

Instead of the connection pieces 15, 16, 18, 19 of the second part-coupling 10 that are provided with the covers 21, the second part-coupling 10 can also have plugs which where necessary close the openings 14 of the connection pieces 11-13 of the first part-coupling 9.

The invention claimed is:

1. A dishwasher, comprising:

a washing compartment having a sidewall;

a basket that is height-adjustable and at least partially extendable from the washing compartment;

a feed pipe, disposed on the basket, for a spray arm; and a coupling device having a first part-coupling disposed on the sidewall and having a predetermined number of first openings and the coupling device having a second part-coupling connected to the feed pipe and having a second opening which, depending on a height adjustment of the basket, cooperates with a respective one of the predetermined number of first openings of the first part-coupling such that, during operation of the dishwasher, washing liquor passes through the respective one of the predetermined number of first openings cooperating with the second opening and through the second opening and flows via the feed pipe to the spray arm;

wherein the predetermined number of first openings are arranged vertically one above another;

wherein, during the operation of the dishwasher, the washing liquor is discharged under pressure from the predetermined number of the first openings;

wherein the second part-coupling includes a predetermined number of uniform second connection pieces fixed in position, wherein the second connection pieces are configured for being inserted into a corresponding one of the predetermined number of first openings to close remaining ones of the predetermined number of first openings that are not cooperating with the second opening;

wherein the second part-coupling has a predetermined number of conical covers attached to and projecting from the second connection pieces for insertion into the first openings; and wherein the second opening of the second part-coupling is structured such that a respective one of the first openings surrounds the second opening.

2. The dishwasher of claim 1, wherein at least one of:

the feed pipe is disposed horizontally on the basket; and the second part-coupling is structured such that the washing liquor flows directly into the feed pipe through the second opening.

3. The dishwasher of claim 1, wherein the second part-coupling has a second connection piece that encompasses the second opening, and wherein the predetermined number of first openings of the first part-coupling are structured such that the second connection piece is insertable into a respective one of the predetermined number of first openings.

4. The dishwasher of claim 3, wherein at least one of:

each of the predetermined number of first openings has a respective first conical shape narrowing toward an interior of the first part-coupling;

the second connection piece has a second conical shape narrowing toward an exterior of the second part-coupling; and the second connection piece has a seal that at least partially surrounds an exterior of the second connection piece.

5. The dishwasher of claim 3, wherein the second part-coupling has a plurality of plugs above and below the second connection piece, each of the plurality of plugs insertable into a respective remaining one of the predetermined number of first openings that are not cooperating with the second opening of the second connection piece in order to close the respective remaining one of the predetermined number of first openings.

6. The dishwasher of claim 5, wherein at least one of:

each of the plurality of plugs has a respective conical shape narrowing toward an exterior of the second part-coupling; and each of the plurality of plugs has a respective seal that at least partially surrounds a respective exterior of each of the plurality of plugs.

7. The dishwasher of claim 3, wherein the second part-coupling has a plurality of third connection pieces above and below the second connection piece, each of the plurality of third connection pieces corresponding to the second connection piece and having a respective third opening that corresponds to the second opening, wherein the respective third opening is closed by a closing device that is one of removable and non- removable, and wherein each of the plurality of third connection pieces is insertable into a respective remaining one of the predetermined number of first openings that are not cooperating with the second opening of the second connection piece in order to close the respective remaining one of the predetermined number of first openings.

8. The dishwasher of claim 7, wherein at least one of:

each of the plurality of third connection pieces has a respective conical shape narrowing toward an exterior of the second part-coupling;

each of the plurality of third connection pieces has a respective seal that at least partially surrounds a respective exterior of each of the plurality of third connection pieces; and a respective closing device of each of the plurality of third connection pieces has a respective conical shape narrowing toward the exterior of the second part-coupling.

9. The dishwasher of claim 3, wherein the first part-coupling has a plurality of uniform first connection pieces, each of the plurality of uniform first connection pieces encompassing a respective one of the predetermined number of first openings.

10. The dishwasher of claim 9, wherein the first part-coupling has three first connection pieces, and wherein the second part-coupling has one of two plugs and third connection pieces arranged above the second connection piece and one of two plugs and third connection pieces arranged below the second connection piece.

11. The dishwasher of claim 1, wherein the second part-coupling and the feed pipe are structured as a single piece.

12. The dishwasher of claim 1, further comprising a first supply pipe disposed on the sidewall to supply the washing liquor, wherein one of the sidewall is connected to the first part-coupling and the sidewall and the first part-coupling are structured as a single piece.

13. A dishwasher, comprising:

a washing compartment having a sidewall;

a basket that is height-adjustable and at least partially extendable from the washing compartment;

a feed pipe, disposed on the basket, for a spray arm; and a coupling device having a first part-coupling disposed on the sidewall and having a predetermined number of first openings and the coupling device having a second part-coupling connected to the feed pipe and having a second opening which, depending on a height adjustment of the basket, cooperates with a respective one of the predetermined number of first openings of the first part-coupling such that, during operation of the dishwasher, washing liquor passes through the respective one of the predetermined number of first openings cooperating with the second opening and through the second opening and flows via the feed pipe to the spray arm;

wherein the predetermined number of first openings are arranged vertically one above another;

wherein, during the operation of the dishwasher, the washing liquor is discharged under pressure from the predetermined number of first openings;

wherein the second part-coupling is structured to close remaining ones of the predetermined number of first openings that are not cooperating with the second opening;

wherein the first part-coupling has uniform first connection pieces, each of the uniform first connection pieces encompassing a corresponding one of the predetermined number of first openings;

wherein the second opening of the second part-coupling is structured such that a respective one of the first openings is configured to surround the second opening;

wherein the second part-coupling has a predetermined number of conical covers attached to and projecting from second connection pieces of the second part-coupling for insertion into the first openings; and wherein at least one of:

each of the second connection pieces has a respective seal that at least partially surrounds a respective exterior of the second connection piece; and the second part-coupling has connection pieces above and below the second opening for insertion into respective remaining ones of the first openings that are not cooperating with the second opening in order to close the predetermined number of first openings.

14. A dishwasher, comprising:

a washing compartment having a sidewall;

a basket that is height-adjustable and at least partially extendable from the washing compartment;

a feed pipe, disposed on the basket, for a spray arm; and a coupling device having a first part-coupling disposed on the sidewall and having a predetermined number of first openings and the coupling device having a second part-coupling connected to the feed pipe and having a second opening which, depending on a height adjustment of the basket, cooperates with a respective one of the predetermined number of first openings of the first part-coupling such that, during operation of the dishwasher, washing liquor passes through the respective one of the predetermined number of first openings cooperating with the second opening and through the second opening and flows via the feed pipe to the spray arm;

wherein the predetermined number of first openings are arranged vertically one above another and at least one of each of the predetermined number of first openings has a respective first conical shape narrowing toward an interior of the first part-coupling;

wherein, during the operation of the dishwasher, the washing liquor is discharged under pressure from the predetermined number of the first openings; and wherein the second part-coupling is structured to close remaining ones of the predetermined number of first openings that are not cooperating with the second opening and wherein the second part-coupling has a second connection piece that encompasses the second opening, and wherein the predetermined number of first openings of the first part-coupling are structured such that the second connection piece is insertable into a respective one of the predetermined number of first openings; and wherein at least one of:

the second connection piece has a second conical shape narrowing toward an exterior of the second part-coupling; and the second connection piece has a seal that at least partially surrounds an exterior of the second connection piece.

* * * * *

UNITED STATES PATENT AND TRADEMARK OFFICE

CERTIFICATE OF CORRECTION

PATENT NO. : 8,561,624 B2
APPLICATION NO. : 12/674720
DATED : October 22, 2013
INVENTOR(S) : Oblinger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 668 days.

Signed and Sealed this
Fifteenth Day of September, 2015

Michelle K. Lee

Michelle K. Lee
*Director of the United States Patent and Trademark Office*